United States Patent [19]

Shaneour

[11] Patent Number: 4,459,649

[45] Date of Patent: Jul. 10, 1984

[54] POLE MOUNTED LIGHTING SYSTEM

[75] Inventor: Dwight C. Shaneour, Hillsdale, Mich.

[73] Assignee: Quality Industries, Inc., Hillsdale, Mich.

[21] Appl. No.: 503,064

[22] Filed: Jun. 10, 1983

[51] Int. Cl.[3] ..... F21V 21/00

[52] U.S. Cl. ..... 362/396; 362/249; 362/431; 362/432; 362/457

[58] Field of Search ..... 362/249, 396, 431, 432, 362/457

[56] References Cited

U.S. PATENT DOCUMENTS 3,213,273 10/1965 Zagel ..... 362/431

3,959,645 5/1976 Patry ..... 362/431

*Primary Examiner*—Stephen J. Lechert, Jr.

*Attorney, Agent, or Firm*—Beaman & Beaman

[57] ABSTRACT

A pole mounted lighting system particularly suitable for lighting athletic fields wherein a lamp supporting frame is mounted adjacent the upper end of a supporting pole. A vertically disposed column is attached to the frame at its central region and includes a cap engaging the pole upper end whereby, during assembly, placing the cap upon the pole upper end permits the frame to be initially positioned and supported upon the pole and permanent pole clamping members are later used to permanently clamp the frame and column to the pole.

7 Claims, 6 Drawing Figures

FIG. 1
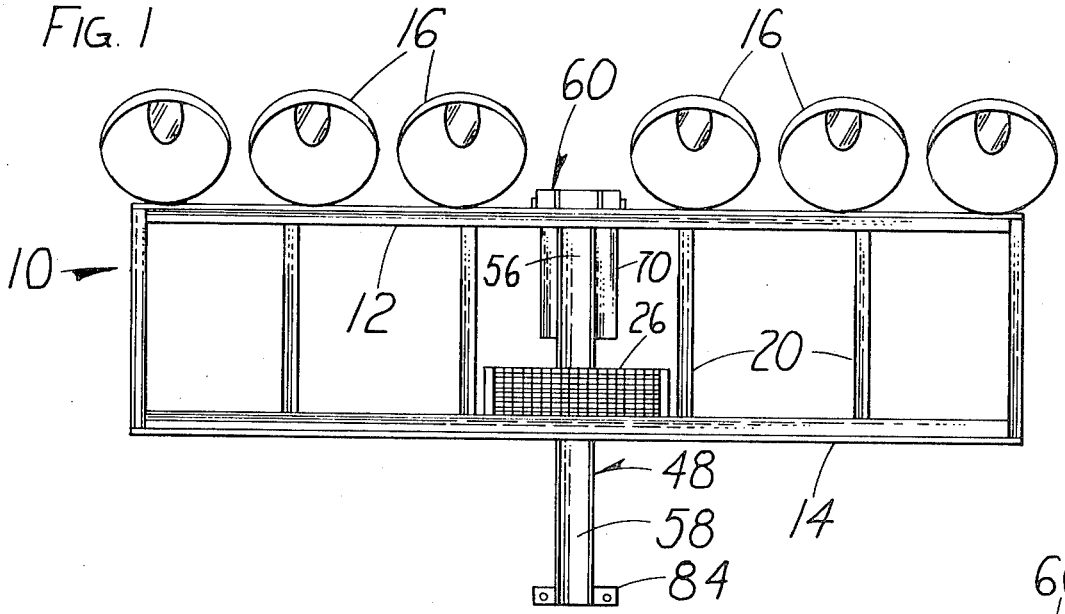
FIG. 3
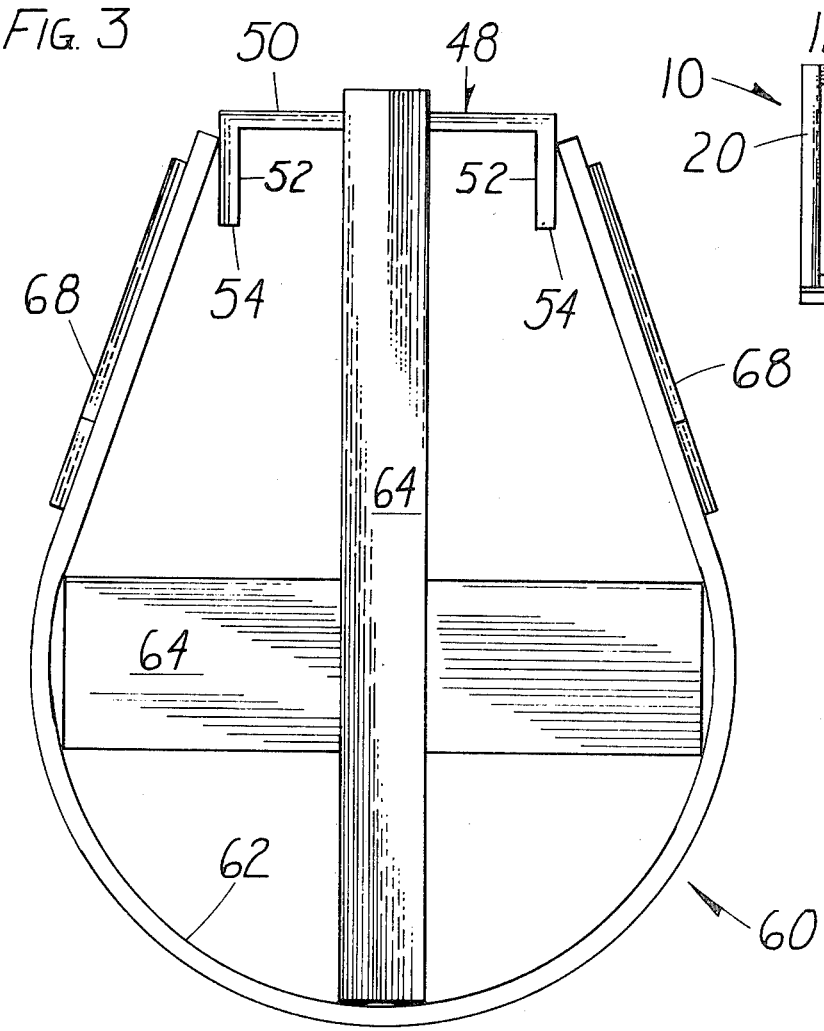
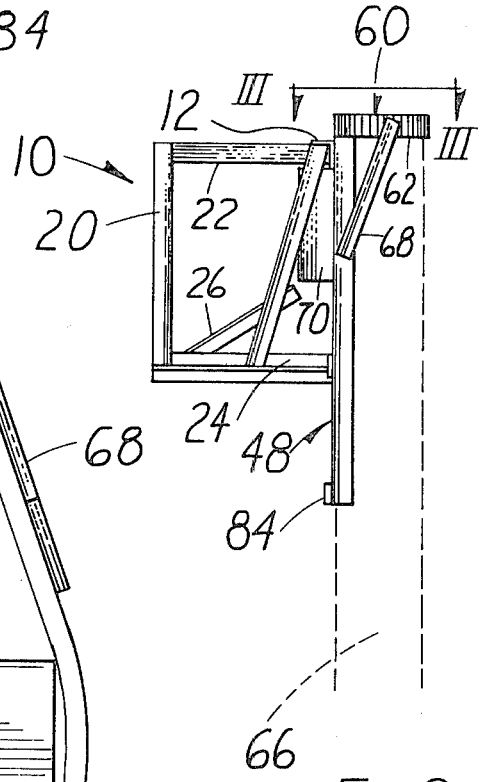
FIG. 2

POLE MOUNTED LIGHTING SYSTEM

BACKGROUND OF THE INVENTION

Lighting systems for athletic fields, such as football fields, stadiums, baseball diamonds, tennis courts and the like often include a horizontally disposed frame upon which a plurality of lamps are mounted. These frames may be multi-storied wherein a battery of high intensity lights are mounted upon a common frame, and the frame will often be heavy and unwieldy to handle.

Outdoor lighting systems are often mounted upon a single pore, either of wood or metal, which may be from 35 to 65 feet high. During installation, the frame is hoisted to the top of the pole, and in the usual practice, it is necessary to align predrilled holes within the frame with holes in the pole, or otherwise align frame mounting structure with pole mounting structure while supporting the frame at its elevated location adjacent the pole upper end. Due to the height, the difficulty of access, the influence of wind, and the difficulty in handling a heavy frame member at a considerable height, installation of lighting system frames is often very troublesome, dangerous, time consuming and expensive.

It is an object of the invention to provide a pole mounted lighting system wherein assembly of the system frame upon the upper end of a supporting pole is simplified.

Another object of the invention is to provide a pole mounted lighting system wherein a frame is mounted upon a pole upper end wherein pole end engaging means supporting the frame permit the frame to be easily initially oriented and supported upon the frame prior to the application of permanent clamps.

Yet a further object of the invention is to provide a pole mounted lighting system utilizing a frame wherein a cap is mounted upon a column attached to the frame wherein the cap receives the pole end for initially supporting and orienting the frame to the pole, and the column is of such configuration as to permanently orient the column frame to the pole and permits clamps to permanently attach the column, and frame, to the pole.

It is yet a further object of the invention to provide a pole mounted lighting system which is characterized by its ease of assembly to even very high poles and which initially orients the lighting structure to the pole prior to permanent installation.

In the practice of the invention an elongated frame upon which lights may be mounted includes a central region to which an elongated column is attached. The column is formed of a U-shaped channel and the legs of the column channel are so oriented as to engage the pole outer surface to align the column and frame to the pole during use.

A cap is affixed to the column adjacent its upper end and the cap includes a pole end engaging member wherein, during initial assembly, the frame and column may be lifted to the pole upper end and the cap aligned with the pole upper end wherein lowering of the assembly causes the cap to receive the pole end thereby initially supporting the unit upon the pole. Once so temporarily supported, permanent affixing of the column to the pole is achieved as the weight of the frame is now borne by the cap and the process of aligning mounting structure on the column and pole is simplified and clamps may be applied to the pole for attaching the column thereto. During use, the pole upper end engages the cap thereby removing shear loads from the clamp or bolts and the practice of the invention produces a high strength light frame support requiring little extra material and labor.

BRIEF DESCRIPTION OF THE DRAWINGS

The aforementioned objects and advantages of the invention will be appreciated from the following description and accompanying drawings wherein:

FIG. 1 is a front elevational view of a lighting system in accord with the invention, lights being attached only to the upper frame cross arm element, FIG. 2 is an elevational side view as taken from the left of FIG. 1, the lights being omitted, FIG. 3 is top plan view of the basket as taken along Section III—III of FIG. 2.

DESCRIPTION OF THE PREFERRED EMBODIMENTS

Figure 4:
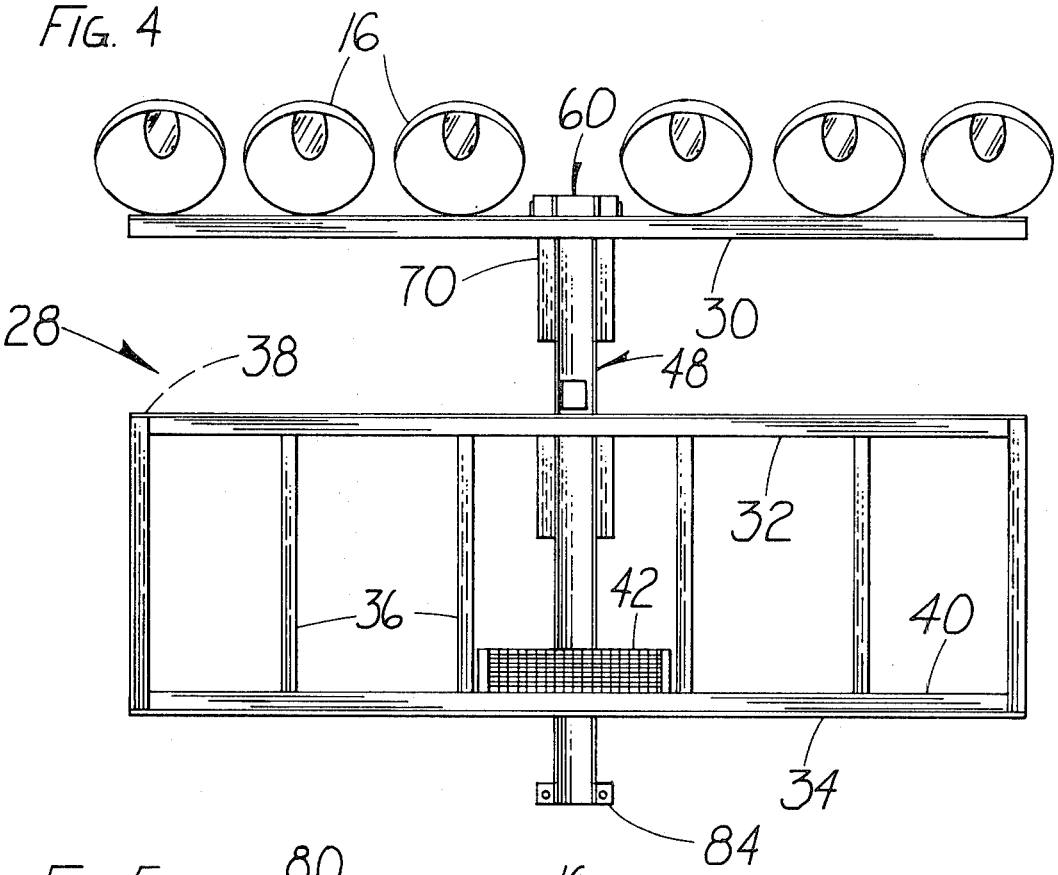
FIG. 4 is a front elevational view of another embodiment of the frame configuration utilizing the invention.

The concepts of the invention may be practiced with a wide variety of frames used to support the lights employed in outdoor athletic field lighting. Each installation is custom designed to meet the particular requirements of the area being illuminated, and in the drawings three different frames are illustrated. In FIG. 1, a typical frame 10 is shown which consists of a pair of cross arms 12 and 14 upon which a battery of lights 16 may be mounted, lights only being shown on the upper cross arm 12. The frame includes rear verticl elements 20 and rails 22 form a service platform 24 having a bottom entry door 26. The frame may be readily fabricated by the use of angle iron and similar standard building component elements.

In FIG. 4 a frame 28 is illustrated consisting of an upper cross arm 30 and two lower cross arms 32 and 34. As with the frame 10 of FIG. 1, the frame 28 includes elements 36 and rails 38 extending from platform 40 to form a catwalk or service platform wherein the lights may be readily serviced, and a bottom entry door 42, is defined in the platform whereby the frame may be entered and the lights serviced.

Figure 5:
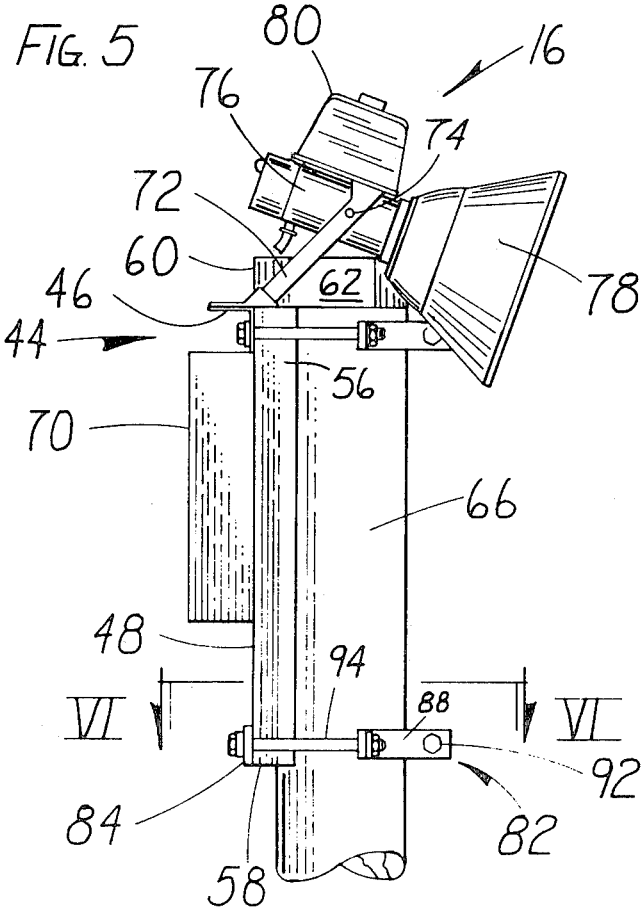
FIG. 5 is a side elevational view of a lighting system utilizing the invention wherein only a single cross bar is illustrated, a lamp being shown in place.

In FIG. 5 a simpler version of frame 44 is illustrated consisting of cross arm 46, identical to the cross arm 30, wherein only a single row of lights are mounted upon a pole.

In each of the aforedescribed light supporting frame embodiments the frame is defined by ends and a central region equidistantly located between the ends. A column 48 is rigidly affixed to the frame, and except for length the column of each of the three embodiments is similar. The column 48 is preferably formed by a U beam or channel having a base 50 from which a pair of parallel legs 52 extend, as will be appreciated from FIG. 6. The legs 52 each terminate in a linear edge 54 which enages the pole at spaced locations wherein the column will maintain itself parallel to the associated supporting pole.

The column 48 includes an upper end 56 and a lower end 58, and a cap, generally indicated at 60, is mounted upon the upper end 56 of the column. The configuration of the cap 60 is best appreciated from FIG. 3, and includes a teardrop shaped rim 62 having upper and lower edges, FIG. 2, and metal strips 64 are welded across the periphery of the cap adjacent the rim upper edge forming a web for engaging the associated pole upper end. While the vertical height of the rim 62 is not great, about 4" in most cases, this height of the rim is sufficient to define a recess large enough to receive the upper end of a supporting pole 66.

As appreciated from FIGS. 2 and 3, the cap rim 62 is welded to the column 48, and is braced with respect thereto by a pair of braces 68 interposed between the cap rim and the column.

Preferably, an electrical junction box 70 is attached to the column 48 adjacent its upper end, and this junction box is used to house the electrical connections required by the lights supported on the frame cross arms. The junction box will include the usual access door, and conduit openings, and by locating the junction box upon the column the lighting unit may be prewired.

The length of the column 48 will vary depending upon the arrangement of cross arms associated therewith. For instance, the length of height of the column 48 utilized with the frame of FIG. 1 is less than that used with the lighting frame of FIG. 4, but greater than that used with the single cross arm embodiment of FIG. 5.

In the embodiment of FIG. 5 the preferred light mounting is illustrated which includes a mounting yoke 72 attached to the cross arm 46, and a horizontal aiming adjustment may be incorporated into the yoke mounting. A pivot 74 attaches the light 76 to the yoke 72 producing a vertical aiming adjustment, and the light including reflector 78 is thereby mounted upon the frame for universal adjustment. The light ballast 80 may be directly attached to the light housing.

In use, the lights 76 may or may not be attached to the associated frame prior to raising the frame to the top of its supporting pole. When it is desired to mount the lighting system to the pole 66 the frame is attached to a crane or hoist and raised sufficiently to align the top of the pole with the cap 60. Thereupon, the frame, and cap, are slowly lowered until the pole upper end is received within the cap and engages the strips 64. This initial mounting of the lighting system upon the pole usually results in the column 48 being substantially parallel to the pole wherein the leg edges 54 will engage the pole and maintain a substantially vertical orientation of the column. It will be appreciated that the web 64, and the cap 60 will now support the entire weight of the lighting unit, and the hoisting cable may be slackened, if desired.

Figure 6:
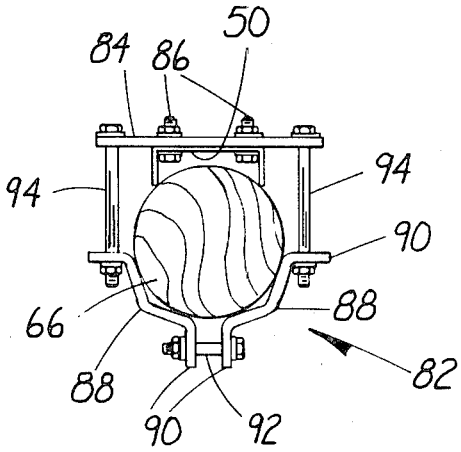
FIG. 6 is a plan, sectional view illustrating the pole clamp as taken along Section VI—VI of FIG. 5.

Clamps 82 are utilized to permanently affix the column to the pole, and these clamps may take the form shown in the drawing, and particularly appreciated from FIG. 6. The clamp includes a rear strap 84 attached to the column base by bolts and nuts 86. Upon the opposite side of the pole a pair of formed clamp elements 88 are utilized each of identical construction having radial flanges 90 in which holes are defined. The elements 88 may be interconnected by bolt 92, and threaded tie rods or bolts 94 interconnect the elements 88 with the rear strip 84 whereby tightening of the bolts 94 will firmly attach the column and frame to the associated pole 66.

As will be noted in FIG. 6, the leg edges 54 of the column engage the counter surface of the pole 66 and align the column in parallel manner with the pole.

The number of clamps 82 that are used with a unit will depend upon the size of the frame and the length of the column. Two clamps would normally be used with embodiments of the type shown in FIGS. 1 and 5, while three clamps would be used with the larger size frame shown in FIG. 4.

It will be appreciated that the aforedescribed construction wherein the weight of the frame may initially be supported upon the cap 60 substantially reduces the time required to mount the frame upon a pole and results in a much safer operation. The practice of the invention does not require the difficult alignment of predrilled bolt holes. As the clamps 82 require no holes through the pole their attachment thereto is simplified, and lighting systems utilizing the concepts of the invention may be properly erected in a much shorter time duration than lighting systems utilizing conventional assembly techniques.

It is appreciated that various modifications to the invention concepts may be apparent to those skilled in the art without departing from the spirit and scope of the invention.

I claim:

1. A pole mounted lighting system for use with a pole having an upper end comprising, in combination, an elongated light supporting frame adapted to be horizontally disposed having ends, a central region equidistantly located between said ends, light mounting means defined upon said frame for receiving and supporting lights, a cap operatively mounted upon said frame at said central region having pole end engaging means defined therein whereby the pole upper end is received within said cap to initially support said frame upon the pole during installation, and pole clamping means operatively mounted upon said frame spaced from said cap adapted to clamp the frame to its supporting pole.

2. In a pole mounted lighting system as in claim 1, an elongated pole engaging column attached to said frame central region transversely disposed to the length of said frame, said column having an upper end and a lower end, said cap being mounted upon said column.

3. In a pole mounted lighting system as in claim 2, said cap being mounted upon said column adjacent said upper end, and pole clamping means being mounted upon said column adjacent said column lower end.

4. In a pole mounted lighting system as in claim 2, said column comprising a U beam having parallel legs extending from a base, said legs each terminating in an elongated edge, said leg edges engaging the supporting pole at spaced parallel locations to align said column with the supporting pole.

5. In a pole mounted lighting system as in claim 3, said cap comprising a peripheral rim defining a recess, and web members affixed to said rim extending thereacross defining said pole end engaging means.

6. In a pole mounted lighting system as in claim 2, an electrical junction box mounted upon said column.

7. In a pole mounted lighting system as in claim 2, said pole clamping means comprising opposed elements adapted to be located on opposite sides of the supporting pole and bolts extending between said opposed elements.

* * * * *